United States Patent [19]

Birge et al.

[11] Patent Number: 4,781,593

[45] Date of Patent: Nov. 1, 1988

[54] LEAD ANGLE CORRECTION FOR WEAPON SIMULATOR APPARATUS AND METHOD

[75] Inventors: Warren A. Birge, Orlando; Richard J. Wangler, Maitland, both of Fla.

[73] Assignee: International Laser Systems, Inc., Orlando, Fla.

[21] Appl. No.: 387,933

[22] Filed: Jun. 14, 1982

[51] Int. Cl.[4] ..... F41F 27/00

[52] U.S. Cl. ..... 434/22; 434/16

[58] Field of Search ..... 434/11, 16, 19, 21, 434/22

[56] References Cited

U.S. PATENT DOCUMENTS 4,063,368 12/1977 McFarland et al. ..... 434/22
4,218,138 8/1980 Robertsson ..... 434/21
4,218,834 8/1980 Robertsson ..... 434/21
4,229,103 10/1980 Hipp ..... 434/21

*Primary Examiner*—Leo P. Picard
*Attorney, Agent, or Firm*—William M. Hobby, III.

[57] ABSTRACT

A laser weapon simulator apparatus requires a gunner to correctly lead a moving target when using a laser direct fire weapon simulator for markmanship training. The weapon simulator includes one or more lasers for firing a plurality of radiation beams along the weapon boresight and on at least one side thereof. An encoding circuit is coupled to the lasers for assigning a code to each radiation beam. A simulated target has a radiation detector for detecting the radiation beams of the lasers and includes a decoder coupled thereto for recognizing each code assigned to each radiation beam and comparing the lead taken by the gunner with the required lead.

8 Claims, 3 Drawing Sheets

LEAD ANGLE CORRECTION FOR WEAPON SIMULATOR APPARATUS AND METHOD

BACKGROUND OF THE INVENTION

The present invention relates to laser weapon simulators and especially to a weapon simulator which requires a gunner to correctly lead a moving target.

Narrow electromagnetic beams produced by lasers, light emitting diodes, millimeter wave devices or other sources of electromagnetic radiation are frequently used to simulate the path of a projectile launched by a direct fire weapon. In such a device, a transmitter arranged to produce a narrow beam of electromagnetic radiation is attached to the weapon or weapon platform in such a manner that the axis of the electromagnetic beam is approximately parallel to the bore or sight of the weapon. Targets at which the simulated fire is directed are equipped with detectors which respond to the radiation emitted by the transmitter. In this way, simulated "hits" are scored when the light of the direct fire weapon is pointed at the target and the transmitter is operated by activating the weapon's trigger mechanism. Devices based on this principle are referred to as weapon simulators.

It is desirable for such weapon simulators to take into account the azimuth and elevation angular offsets that must be applied to the aim point of a real weapon to accommodate the component of target velocity perpendicular to the line sight, and the gravity-induced drop of the projectile from a straight line over the path from weapon to target. These angular offsets or corrections are called "lead" and "super elevation" respectively, and are well known to those skilled in the science of gunnery.

This invention relates to a means for providing lead correction to direct fire weapon simulators, i.e., for requiring the gunner to take the proper lead in order to score a "hit" against the simulated target.

SUMMARY OF THE INVENTION

A laser weapon simulator is provided which requires a gunner to correctly lead a moving target when using a laser direct fire weapon simulator for markmanship training.

At least one laser is positioned for firing a plurality of radiation beams along a weapon sight and on at least one side thereof and an encoder is coupled to the laser for assigning a code to each radiation beam. A movable target has a radiation detector for detecting the radiation beam which is coupled to the decoder for comparing the lead taken by the gunner with the required lead to indicate whether the gunner has made a hit.

A method of determining the correct lead for a moving target on a laser weapon system is also provided and includes the steps of encoding a plurality of adjacent laser beams fired along a weapon bore sight, directing the beams towards a target having a laser detector thereon and decoding the encoded laser beams to determine the lead of the laser weapon simulator.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
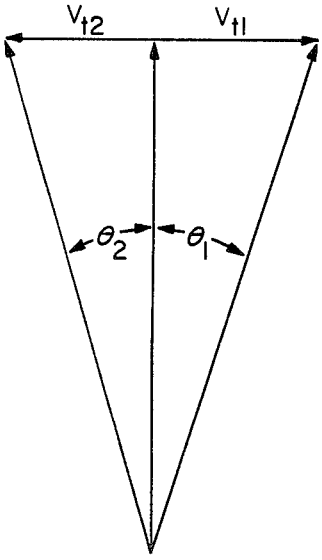
FIG. 1 is a diagrammatic view showing the lead angle geometry for moving targets.

Lead angle correction for a moving target is accomplished in the case of real projectiles by aiming the weapon ahead of the target by an angle which is proportional to the component of target velocity perpendicular to the line of sight to the target and inversely proportional to the component of target velocity perpendicular to the line of sight to the target and inversely proportional to the projectile speed over its path. FIG. 1 shows the angular offsets or lead $\theta_1$ and $\theta_2$ required to hit two targets moving with perpendicular velocity components $V_{t1}$ and $V_{t2}$, respectively, when the average projectile speed is Vp. The lead angle is thus: $\theta = \tan - 1\ (V_\theta / V_p)$ Because the speed of electromagnetic radiation is much greater than that of a projectile, it is not necessary for a weapon simulator of the kind referred to herein to lead a moving target in order to score a hit. This is a major disadvantage when a weapon simulator is used for markmanship and gunnery training because it introduces a negative training aspect.

Figure 2:
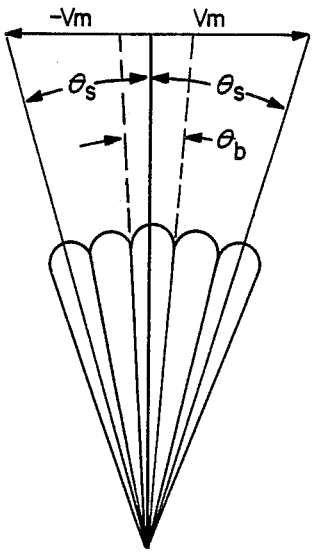
FIG. 2 is a diagrammatic view of multiple beam geometry for determining the lead angle for a moving target.
Figure 3A:
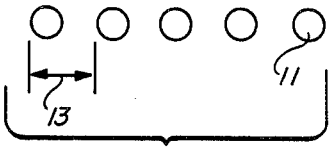
FIG. 3 is a diagrammatic view of the beams formed by fiber optics directed at a lens.
Figure 4:
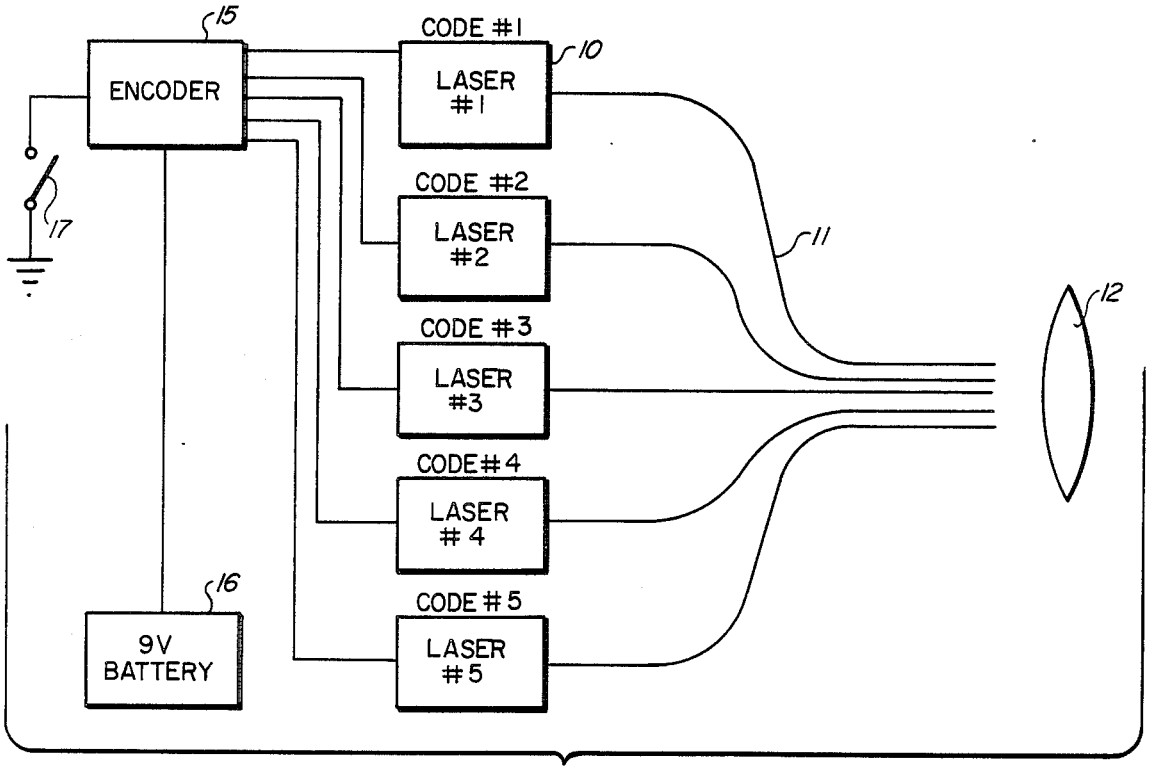
FIG. 4 is a block diagram of the encoder and the laser connected to the fiber optics.
Figure 3:
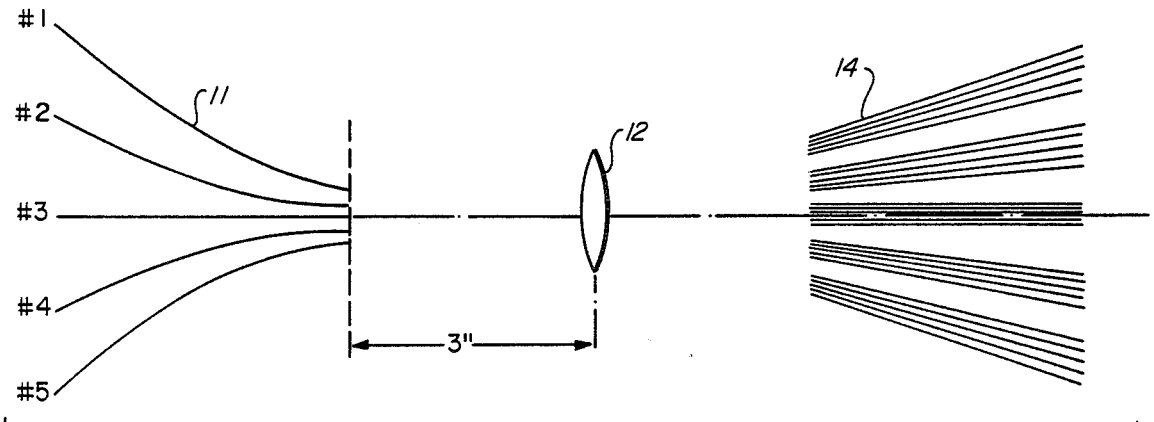

In FIG. 2, electromagnetic beams simulating the projectile path are cause to sequentially point in all of the azimuthal directions, relative to the bore sight of the simulated weapon, that would be necessary to correctly lead any or all of the targets which the simulator is intended to engage. The maximum perpendicular target velocity is $\pm V_m$, so that the transmitter beams are made to cover a range of angles $\theta = +\tan - 1(V_m/V_s)$ relative to the weapon bore sight. This range of angles may be covered sequentially by a single transmitter beam stepped or smoothly scanned over $\pm\theta_s$ or by N beams individually included to the bore sight direction so as to simultaneously cover the section $\pm\theta_s$. In either case, the number of N of stepped or scanned positions, or of simultaneous individual beams depends upon the width $\theta_b$ of an individual beam as can be inferred from FIG. 2. The beam width $\theta_b$, in turn, depends on the laterial target definition required of the system FIGS. 3 and 4 show the utilization of five separate laser diodes 10 connected to a plurality of fiber optic fibers 11 spaced with their output at the focal plane of the lens 12 and spaced in a horizontal line having a spacing 13 which might, for instance, be 0.0045 inches. The lenticular shaped lens 12 produces a plurality of beams 14 formed from the radiated energy passing through the optical fibers 11. The transmission from each separate beam 14 is assigned a code by the encoder 15 so that the angular space surrounding the weapon in the required vicinity of its bore sight direction is uniquely encoded by simultaneous or sequential electromagnetic radiation. In the case of a pulsed laser weapon simulator, a different pulse position code may be assigned to each angular beam position.

Figure 5:
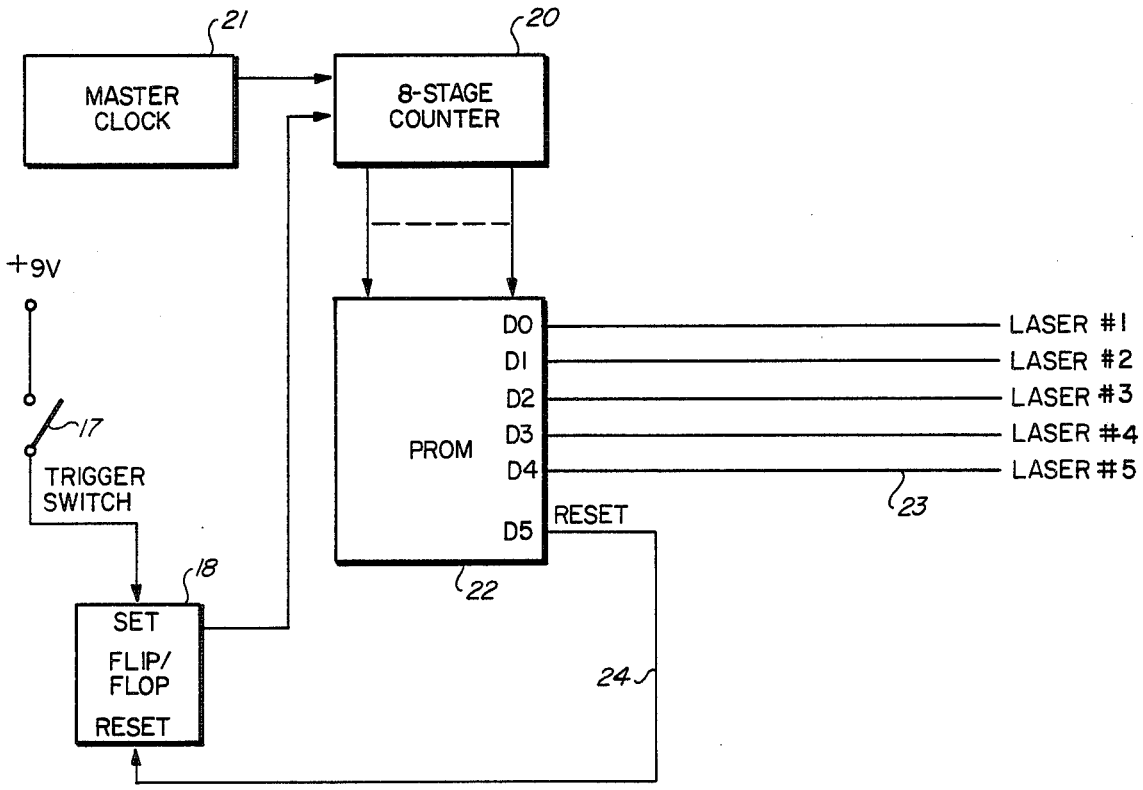
FIG. 5 is a block diagram of the encoder.
Figure 6:
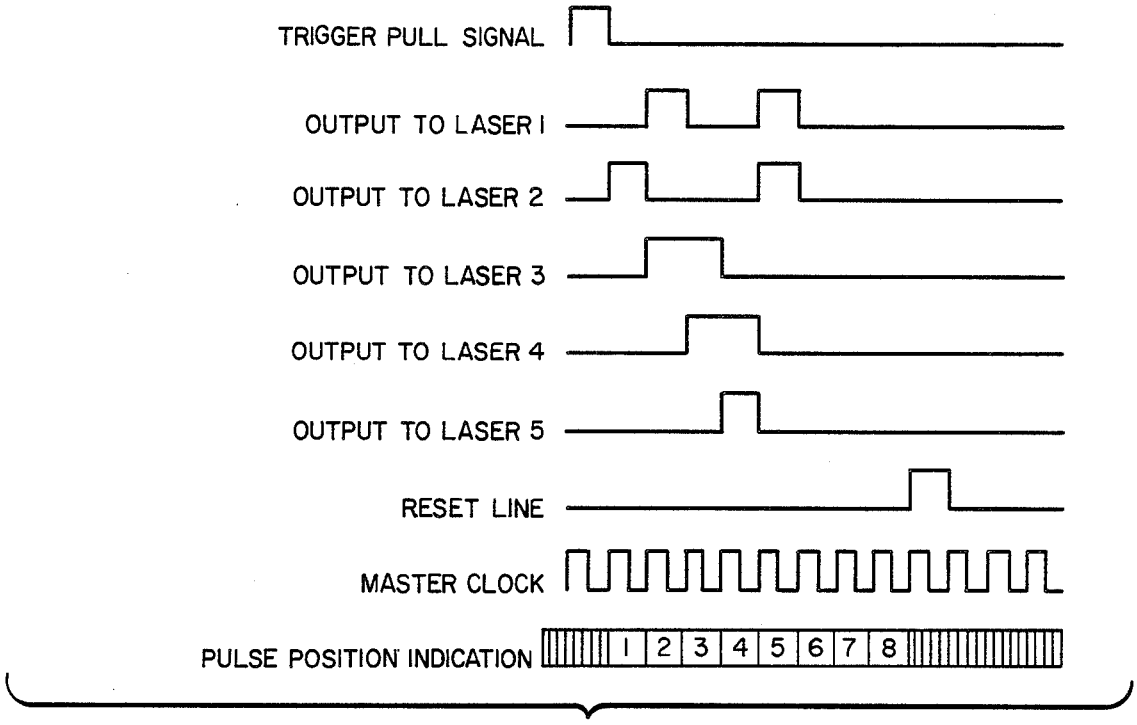
FIG. 6 is a waveform diagram of encoding signals from the encoder.

FIG. 6 shows an example of an 8-bit transmit sequence from a PROM memory in the encoder 15 showing a trigger pull signal along with an output code for each of the five lasers 10 along with a master clock signal from the encoder in a pulse position indication. The encoder 15 receives its power from a 9 volt battery 16 and is actuated by the trigger switch 17. The encoder is more clearly shown in FIG. 5 having the trigger switch 17 connected to a set-reset flip flop 18, which in turn is connected to an 8-stage counter 20, which has the master clock 21 connected thereto. The 8-stage counter 20 is connected to a PROM 22 which in turn is connected by lines 23 to each of the five lasers 10. The PROM is also connected through a reset line 24 to the set-reset flip flop 18. The PROM 22 is actuated by the 8-stage counter 20 which produces an 8-bit transmit sequence as shown in FIG. 6.

It should be clear at this point that other coding techniques can be utilized with the only requirement being that the time function fi(t) be members of an orthogonal set without departing from the spirit and scope of the invention.

In FIG. 6, the high pulses indicate a high voltage level which causes the laser diode to fire for the length of the sequence of the voltage pulse, emitting from the PROM 22. Thus, pulse position modulation of five lasers simultaneously is carried out by the use of a master clock 21 that is used as a base frequency for a binary output counter 20, which in turn is used to sequentially address each data location and a PROM 22 that contains the data to be transferred. Whenever the trigger 17 pull is sensed by the system, the counter 20 begins clocking at the master clock frequency. Each clock pulse causes the output of the counter to increment in a binary fashion such that the output is actually an incremental 8-bit binary word. This 8-bit word incrementally addresses each location in a pre-programmed read only memory 22. The PROM 22 outputs 8-bits of data simultaneously, each address selected sequentially addressing the PROM, the eight outputs appear as eight separate serial streams of data, as shown in FIG. 6. Five of these serial data streams are used to activate each of the five lasers 10 in the system. A sixth output is used in the transmit sequence, while the remaining outputs are not used.

The PROM allows recognizable pulse positioning modulated data to be output so that each data bit that is output requires meaning from its position and time with respect to the master clock frequency. Data transferred in this matter has a predefined message length, as shown in FIG. 6. The message length as shown in the timing diagram is eight master clock periods long with an 8-bit transmit message and a total of 128 different messages can be sent from all data positions being low to all data positions being high. After the 8-bit transmission of the laser pulses is finished, the pre-programmed reset line 24 goes to a high voltage level and resets the counter. The counter stays in the reset condition, which outputs a binary count of zero until the next trigger pull occurs. All outputs from the PROM 22 are low at this address, and therefore, no laser transmissions occur. Whenever a trigger pull is actuated, the counter 20 is allowed to clock and the sequence begins again.

In the type of direct fire weapon simulator for which this invention is intended, the target is equipped with a detector or detectors of the electromagnetic radiation transmitted by the direct fire weapon simulator. For purposes of lead angle correction as described herein, the electromagnetic radiation detector is followed by a decoder which is designed to recognize which of the unique time functions of $f_i(t)$ transmitted by the weapon simulator has illuminated the target. By this means the target receiver has determined the angular position of the weapon bore sight relative to the weapon target line of sight at the time of fire. The angle so determined is the azimuth lead angle.

It remains to compare this lead angle with the correct value of lead angle for the circumstances in order to determine if a hit has been scored. For targets used on markmanship training ranges, the target scalar speed is ordinarily limited to only one, or at most a few, values and the target moves from left to right or from right to left along a fixed track. The orientation of the fixed track relative to the gunner's firing position is also know as is the type of ammunition and hence the average projectile velocity being simulated. As a consequence, the possible velocities of the target perpendicular to the line of sight are easily determined for all target scalar speeds and directions of motion is either provided by electrical or mechanical signals from the moving target platforms. When the target is set in motion, therefore, sufficient information is available to specify the lead angle which the gunner must take to hit it. Knowing the relationship by means of which the off bore sight beam angle $\theta_1$ is encoded onto the weapon simulator's transmitted time function $f_i(t)$, the receiver/decoder can determine what time function it must receive in order to be "hit". This determination can be done by direct computation, by a look-up table, or by other means. The decoder logic must take into account the "sense" of the time function that must be received in order to be scored as a proper lead, recognizing that if the weapon is required to lead the target by $\theta_i$, the proper time function is that belonging to an off-bore sight angle of $\theta_i$.

Figure 7:
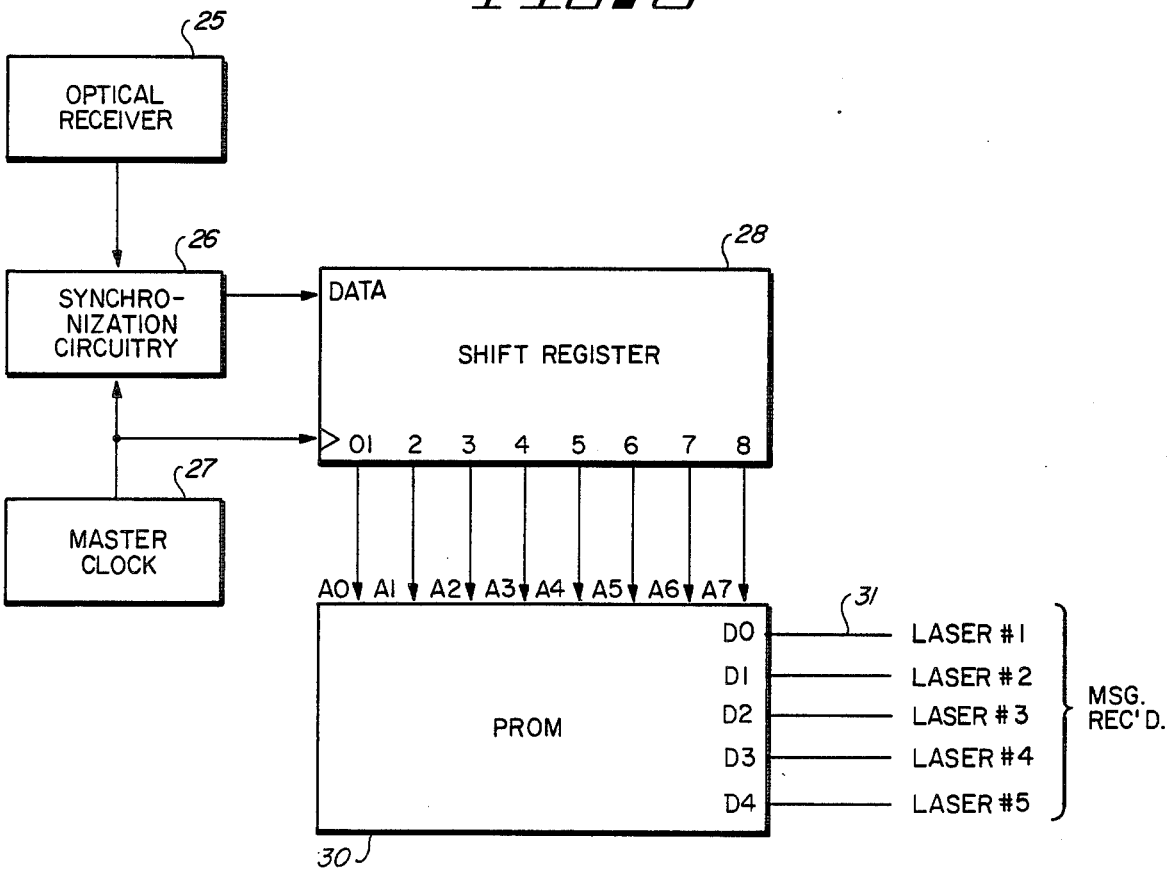
FIG. 7 is a block diagram of the decoding circuit.

Turning to the block diagram of FIG. 7, the laser pulse from the lasers 10 activates an optical detector target 25 attached to a movable target (not shown) and feeds the received laser pulses to a synchronization circuit 26. The optical detector 25 produces a voltage pulse each time a laser pulse is sensed. These pulses are synchronized in the circuit 26 to the decoder master clock 27 so that the pulse train information can be identified directly with respect to its position and time as compared to the master clock time period. Once synchronized, the data pulses are clocked into an 8-bit shift register. The 8-bit shift register converts serial pulse position modulated data into a parallel simultaneously occurring 8-bit binary word. The binary word is used to address a pre-programmed PROM memory 30 and address locations whose binary representation is equal to the 8-bit code of each of the five lasers 10 transmission codes produced by the encoder 15. One of the five used output lines 31 is programmed to produce an output. Whenever the address from the shift register 28 is the same as one of the five laser transmission codes produced by the encoder, the particular output from the PROM that goes high indicates which of the five different laser messages has been received.

A method of determining the correct lead for a moving target on a laser weapon simulator system is also provided which includes the steps of encoding a plurality of adjacent laser beams fired along a weapon bore sight, directing the laser beams towards a target having a laser beam detector thereon and decoding the encoded laser beams to determine the lead of the laser weapon simulator.

It should be clear at this point that a weapon simulator has been provided which enables a gunner to correctly lead a moving target when using a laser direct fire weapon simulator for markmanship training. It should, however, also be clear that it is anticipated that the simulator will be attached directly to a gunner's weapon and that the optical detector and decoder can be attached directly to existing training targets. The optical receivers can be of any different type, such as shown in U.S. Pat. No. 4,299,393 for an AREA RADIATION TARGET. It will also be clear that the blocks in the block diagram are all conventional circuit elements.

Accordingly, the present invention is not to be construed as limited to the forms shown, which are to be considered illustrative rather than restrictive.

We claim:

1. A laser weapon simulator apparatus comprising in combination:

laser means for firing a plurality of radiation beams along a weapon bore sight and on at least one side thereof;

encoding means coupled to said laser means for assigning a code to each laser means beam;

a movable target;

a radiation detector means attached to said movable target for detecting said laser means radiation beam;

decoding means coupled to said radiation detection means for decoding the detected laser beam; and comparing means for comparing the lead angle of said laser means radiation beam with the correct value of lead angle for the target velocity, whereby a determination is made of whether the laser weapon simulator was fired with the correct lead at the moving target.

2. A laser weapon simulator apparatus in accordance with claim 1, in which said laser means includes a plurality of laser diodes.

3. A laser weapon simulator apparatus in accordance with claim 2, in which each of said laser diodes is connected to one of a plurality of optical fibers for directing a radiation beam from each said laser diode into one said optical fiber.

4. A laser weapon simulator apparatus in accordance with claim 2, in which each of said plurality of said laser diodes are actuated responsive to said encoding means to produce a coded laser beam.

5. A laser weapon simulator apparatus in accordance with claim 4, including a trigger switch for actuating a counter circuit to initiate a memory output to thereby actuate the laser diode.

6. A laser weapon simulator apparatus in accordance with claim 5, in which the trigger switch is coupled to a flip flop circuit having a reset signal from said memory output for directing a voltage signal to actuate said counter circuit.

7. A laser weapon simulator apparatus in accordance with claim 6, in which said radiation detector means has a laser beam detector coupled to a shift register to thereby actuate the shift register to actuate a memory output to indicate the laser signals received.

8. A method of determining the correct lead for a moving target in a laser weapon simulator system comprising the steps of:

encoding a plurality of adjacent laser beams fired along a weapon bore sight;

directing said laser beams towards a target having a laser beam detector thereon;

detecting at least one laser beam of said adjacent laser beams with said laser beam detector;

decoding said detected encoded laser beams to determine the lead of a laser weapon simulator; and compared the lead angle of one said laser beam with the correct value of lead angle for the moving target velocity.

* * * * *